US007859412B2

(12) United States Patent
Kothari et al.

(10) Patent No.: US 7,859,412 B2
(45) Date of Patent: Dec. 28, 2010

(54) SYSTEM AND METHOD OF MONITORING MODULES OF PRINTING MACHINES UTILIZING RFID TAGS

(75) Inventors: Pravin N. Kothari, Poughkeepsie, NY (US); Mark Steven Amico, Pittsford, NY (US); Paul Allen Hosier, Rochester, NY (US); Khan Lutful Kabir, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 304 days.

(21) Appl. No.: 12/139,858

(22) Filed: Jun. 16, 2008

(65) Prior Publication Data

US 2009/0309730 A1 Dec. 17, 2009

(51) Int. Cl.
*G08B 13/14* (2006.01)

(52) U.S. Cl. ..... 340/572.1; 340/572.4; 340/572.7; 340/572.8; 340/5.21; 340/5.8; 340/10.1; 340/10.3; 713/168; 713/169; 713/171; 713/175; 713/181; 235/385; 235/475; 235/487; 235/492; 707/704; 399/12; 399/24; 399/81

(58) Field of Classification Search ..... 340/572.1, 340/572.4, 572.7, 572.8, 5.21, 5.8, 10.1, 340/10.3; 713/168, 169, 171, 175, 181; 235/385, 475, 487, 492; 707/704; 399/12, 399/24, 81

See application file for complete search history.

(56) References Cited

U.S. PATENT DOCUMENTS 5,629,981 A 5/1997 Nerlikar
5,918,085 A 6/1999 Rollins et al.
5,949,335 A 9/1999 Maynard
5,959,530 A 9/1999 Lupien, Jr. et al.
6,111,506 A 8/2000 Yap et al.
6,233,409 B1 5/2001 Haines et al.
6,268,797 B1 7/2001 Berube et al.
6,332,062 B1 * 12/2001 Phillips et al. ..... 399/12
6,342,837 B1 1/2002 Lai et al.
6,351,621 B1 2/2002 Richards et al.

(Continued)

OTHER PUBLICATIONS

US 7,165,720, 01/2007, Linton et al. (withdrawn)

*Primary Examiner*—Tai T Nguyen
(74) *Attorney, Agent, or Firm*—Carter, DeLuca, Farrell & Schmidt, LLP

(57) ABSTRACT

A module monitoring system and related method includes a plurality of nodes and a server component. Each node of the plurality of nodes is in operative communication with a network and with at least one RFID attached to a module. Each node of the plurality of nodes is a node type and at least two nodes of the plurality of nodes are different node types. A node of the at least two nodes is a printer-based node and is associated with a printing machine. The node associated with the printing machine is also in operative communication with a local RFID tag attached to a corresponding module. The server component includes a network interface and an analysis component. The network interface is in operative communication with the network and communicates with the at least two nodes utilizing the network. The analysis component utilizes the network interface to communicate with the node such that the analysis component is additionally in operative communication with the local RFID tag attached to the corresponding module. The node associated with the printing machine operatively interrogates the local RFID tag to retrieve information relating to the corresponding module and communicates the information to the server component.

19 Claims, 2 Drawing Sheets

U.S. PATENT DOCUMENTS 6,385,407 B1 5/2002 Inose
6,477,530 B1 11/2002 Omata et al.
6,478,229 B1 11/2002 Epstein
6,481,907 B2 11/2002 Banach et al.
6,593,853 B1 7/2003 Barrett et al.
6,609,969 B1 8/2003 Luciano et al.
6,687,634 B2 2/2004 Borg
6,694,884 B2 2/2004 Klinefelter et al.
6,710,891 B1 3/2004 Vraa et al.
6,717,516 B2 4/2004 Bridgelall
6,738,903 B1 5/2004 Haines
6,817,693 B2 11/2004 Phillips et al.
6,819,446 B1 11/2004 Ogawa et al.
6,827,279 B2 12/2004 Teraura
6,892,033 B2 5/2005 Sunada et al.
7,007,854 B2 3/2006 Okamoto et al.
7,009,517 B2 3/2006 Wood
7,031,803 B2 4/2006 Eneau et al.
7,095,964 B2 8/2006 Koyama et al.
7,119,822 B2 10/2006 Kobayashi et al.
7,123,377 B2 10/2006 Ogawa et al.
7,183,924 B1 2/2007 Ku
7,195,171 B2 3/2007 Oyama
7,258,276 B2 8/2007 Linton et al.
7,269,361 B2 9/2007 Huss et al.
7,270,271 B2 9/2007 Yokoyama
7,299,990 B2 11/2007 Hoshina
7,307,531 B2 12/2007 Rommelmann et al.
7,327,259 B2 2/2008 Kim et al.
7,653,570 B2 1/2010 May
7,688,794 B2 3/2010 Tredoux et al.
2003/0034390 A1 2/2003 Linton et al.
2004/0051894 A1 3/2004 Gillam et al.
2005/0024465 A1 2/2005 Kobayashi et al.
2005/0029353 A1 2/2005 Isemura et al.
2006/0022827 A1 2/2006 Higham
2006/0071063 A1 4/2006 Duckett
2006/0091671 A1 5/2006 Raming
2006/0224472 A1 10/2006 May
2006/0267765 A1 11/2006 Morton
2007/0035762 A1 2/2007 Wilsher et al.
2007/0036558 A1 2/2007 Huss et al.
2007/0080786 A1* 4/2007 Kusumi ..... 340/10.1
2007/0133041 A1 6/2007 Tredoux et al.
2007/0177200 A1 8/2007 Ohta
2007/0252718 A1 11/2007 Ray
2008/0030746 A1 2/2008 Matsunaga et al.
2008/0037034 A1 2/2008 Ishii
2008/0055089 A1 3/2008 Gustafsson
2008/0068140 A1 3/2008 Taki et al.
2008/0074692 A1 3/2008 Suzuki et al.
2008/0074695 A1 3/2008 Ikeno et al.
2008/0074706 A1 3/2008 Ueno et al.
2008/0074710 A1 3/2008 Suzuki et al.
2008/0077465 A1 3/2008 Schimpf et al.
2008/0083823 A1 4/2008 Revankar et al.
2008/0278743 A1 11/2008 Hardy, Jr. et al.
2009/0089111 A1 4/2009 Walker et al.
2009/0265365 A1 10/2009 Evanitsky
2009/0284387 A1 11/2009 Marchetti
2009/0314836 A1 12/2009 Kothari et al.

* cited by examiner

SYSTEM AND METHOD OF MONITORING MODULES OF PRINTING MACHINES UTILIZING RFID TAGS

BACKGROUND

1. Technical Field

The present disclosure relates to printing machines. In particular, the present disclosure relates to monitoring modules, e.g., consumer replaceable units (herein after referred to as "CRUs"), of printing machines utilizing RFID tags attached thereto.

2. Description of the Related Art

Automatic Identification and Data Capture, also known as AIDC, refers to the method of automatically identifying objects, collecting data about them, and entering that data directly into computer systems (or other mediums of storage) with minimal, or no, human involvement. AIDC technologies include barcodes, and radio frequency identification (RFID). An AIDC device is a device for reading, and/or writing, data encoded in AIDC media, such as a barcode scanner for reading data encoded in a barcode, or an RFID interrogator for reading and/or writing data encoded in an RFID tag.

RFID is a method for automatic identification which uses radiofrequency (RF) signals. A device known as an RFID interrogator which includes an RFID writer and/or a RFID reader, wirelessly reads, and optionally, writes data stored in a transponder, known as an RFID tag, that is physically attached to an article, such as a product, packaging or shipping container. Typically, an RFID tag consists of two main components: an integrated circuit (IC) for storing and processing data and for modulating and demodulating the RF signal, and an antenna coupled to the chip that enables the chip to exchange data between the tag and interrogator. An RFID tag can be read-only, wherein the IC contains unalterable data, such as a unique identification code indelibly encoded by the tag manufacturer which is used to uniquely identify the tag. Alternatively, an RFID tag can be read-write, wherein the stored data can be changed or deleted. Typically, however, a read-write RFID tag will also contain read-only data, such as an indelible unique identification code, so that individual tags can be uniquely identified.

RFID tags ordinarily range in sizes from several inches to sizes no larger than a grain of rice. RFID tags can be constructed using an essentially planar form factor and incorporated into a self-adhesive label, for example. It is expected the ability to print RFID tags, much like a barcode is printed, will eventually become widespread using, for example, techniques developed by Xerox for depositing liquid polythiophene semiconductors onto a surface at room temperature.

RFID tags fall generally into three categories: passive RFID tags, in which the IC is powered entirely by the minute current induced in the antenna by the RFID interrogator's signal and where the transmitted RF signal is generated by backscattering the interrogating signal; active RFID tags, in which the IC and the RF transmitter are powered by an included power source, such as an internal battery; and semi-active RFID tags, in which the IC is powered by an included power source while the transmitted RF signal is generated by backscattering. RFID tags typically operate in one of five RF bands: in the low frequency (LF) range of 125-135 KHz, in the 13.56 MHz high frequency (HF) region, in the ultra high frequency (UHF) range of 868-930 MHz, in the 2.45 GHz microwave region, and in the 5.8 GHz microwave region. RFID tags are operational at distances ranging from a few inches to several yards in the case of passive tags, while active tags can operate at distances of over a quarter-mile.

Additionally, sensors can be included in an RFID tag to enable the tag to measure and record temperature, humidity, G-forces, radiation, and/or other environmental phenomena, which can thereafter be read by the interrogator to determine whether the tagged item has been exposed to extreme or undesirable conditions. Such RFID tags are commonly used in, for example, the shipment and handling of perishable, fragile or sensitive items. An RFID tag can also have the ability to be rendered permanently inoperable upon receiving an appropriate "self-destruct" command from the RFID interrogator. Demand for these kinds of creative solutions (and other solutions) utilizing RFID tags has continued to be strong in recent years.

SUMMARY

The present disclosure relates to printing machines. In particular, the present disclosure relates to monitoring modules, e.g., consumer replaceable units (referred to herein as "CRUs"), of printing machines utilizing RFID tags attached thereto. A printing machine may be an image forming apparatus, a printer, a printing system, a copier, a facsimile machine, a multifunction device (e.g., a scanner integrated with a printer) and/or the like. A module may be, for example, a consumer replaceable unit, an installable module installable in a printing machine (e.g., installable by a technician or an end-user) and/or the like. A module may or may not be related to marking and may need periodic replacement, e.g., a roller or an oil wick.

In one embodiment of the present disclosure, a module monitoring system includes a plurality of nodes and a server component. The plurality of nodes and/or the server component may be at least partially implemented by an operative set of processor executable instructions configured for execution by at least one processor. Each node of the plurality of nodes is in operative communication with a network. Additionally, each node of the plurality of nodes is in operative communication with at least one RFID attached to a module. Each node of the plurality of nodes is a node type and at least two nodes of the plurality of nodes are different node types. A node of the two nodes being different node types is a printer-based node and is associated with a printing machine. The node types include printer-based nodes, cabinet-based nodes and supply-room-based nodes. The node associated with the printing machine is also in operative communication with a local RFID tag attached to a corresponding module.

The server component includes a network interface and an analysis component. The network interface is in operative communication with the network and communicates data with the at least two nodes being different node types utilizing the network. The analysis component utilizes the network interface to communicate with the node associated with the printing machine such that the analysis component is additionally in operative communication with the local RFID tag attached to the corresponding module. The node associated with the printing machine can interrogate the local RFID tag to retrieve information relating to the corresponding module and communicate the information to the server component. The corresponding module may be a CRU, a photoreceptor drum, a photoreceptor belt, a fuser roll, a toner bottle, a toner drum, a fluid container, a filter, a web cartridge, an AC dicor module, a DC charge assay, an AC dicor preclean and/or a developer waste bottle.

In another embodiment of the present disclosure, the system includes a node associated with the printing machine and another node that is a cabinet-based node associated with a cabinet. Both nodes operatively update an approximate level of remaining usage of the corresponding module utilizing the information on the local RFID. For example, an approximate level of usage may be an ink level or the number of pages printed. The approximate level of usage may be stored on the RFID tag, on a central several that associates the approximate level of usage with the module (e.g., by using a serial number located on the RFID tag), or otherwise tracks and/or updates periodically the approximate level of usage.

In yet another embodiment of the present disclosure, a node of the plurality of nodes, e.g., the node associated with the printing machine, can operatively interrogate the local RFID tag to retrieve anti-counterfeiting information. The anti-counterfeiting information can be operatively communicated to the server component. The server component can determine if the corresponding module is a counterfeit module.

In another embodiment of the present disclosure, the system further includes a database component (e.g., a SQL server). The database component may be at least partially implemented by an operative set of processor executable instructions configured for execution by one or more processors. The database component is in operative communication with the analysis component and the analysis component operatively communicates with the local RFID tag attached to the corresponding module to determine a property of the local RFID tag and/or the corresponding module. The analysis component communicates the property to the database component. The database component stores the property and associates it with the local RFID tag and/or the corresponding module.

The property (or properties) of the corresponding module may include one or more of an End-Of-Life estimate, a version number, a revision number, a firmware version, a manufacturer source, a model number, a shipping number, a date of manufacture, a lot number, a factory association and/or a pedigree. A sensor may be utilized to sense one or more of the properties of the corresponding module. The sensor operatively communicates the one or more properties to a RFID writer, which writes the one or more properties to the local RFID tag. The End-Of-Life estimate can be estimated by the analysis component utilizing one or more of a page count, a toner volume, a power on time, a usage, a remaining usage and/or a pixel count. One or more of the page count, the toner volume, the power on time, the usage, the remaining usage and/or the pixel count may be stored in the local RFID tag. The End-Of-Life estimate can be compared to a predicated End-Of-Life estimate by the analysis component.

In another embodiment of the present disclosure, the analysis component operatively communicates with the plurality of nodes including the at least two nodes being different node types to determine a plurality of End-Of-Life estimates. Each End-Of-Life estimate corresponds to a corresponding module having a corresponding RFID tag attached thereto. The analysis component can utilize the corresponding RFID tag to determine an End-Of-Life estimate of the corresponding module. The analysis component compares the plurality of End-Of-Life estimates to a plurality of predicted End-Of-File estimates to identify a plurality of increased-wear modules.

The analysis component can utilize the identified plurality of increased-wear modules to identify a printing machine having an increased-wear fault. The increased-wear fault causes the increased-wear modules to have increase wear. For example, photoreceptive belts that are utilized by a particular printing machine may experience high wear and have a shortened life when used in that particular printing machine. The analysis component can order a replacement module to compensate for an increased-wear module of the plurality of increased-wear modules. Additionally or alternatively, the analysis component can order a replacement printing machine part to negate the increased-wear fault.

In another embodiment of the present disclosure, the analysis component operatively communicates with the node to determine one or more of an inventory level, a usage rate of the corresponding module, a printing machine health statistic, a hardware compliance of the corresponding module and/or a software compliance of the corresponding module.

In another embodiment of the present disclosure, a method of monitoring a module includes providing the plurality of nodes and providing the server component. The method also includes interrogating the local RFID tag utilizing the node associated with the printing machine to retrieve information relating to the corresponding module and communicating the information to the server component. The method can also estimate an End-Of-Life estimate of the corresponding module.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
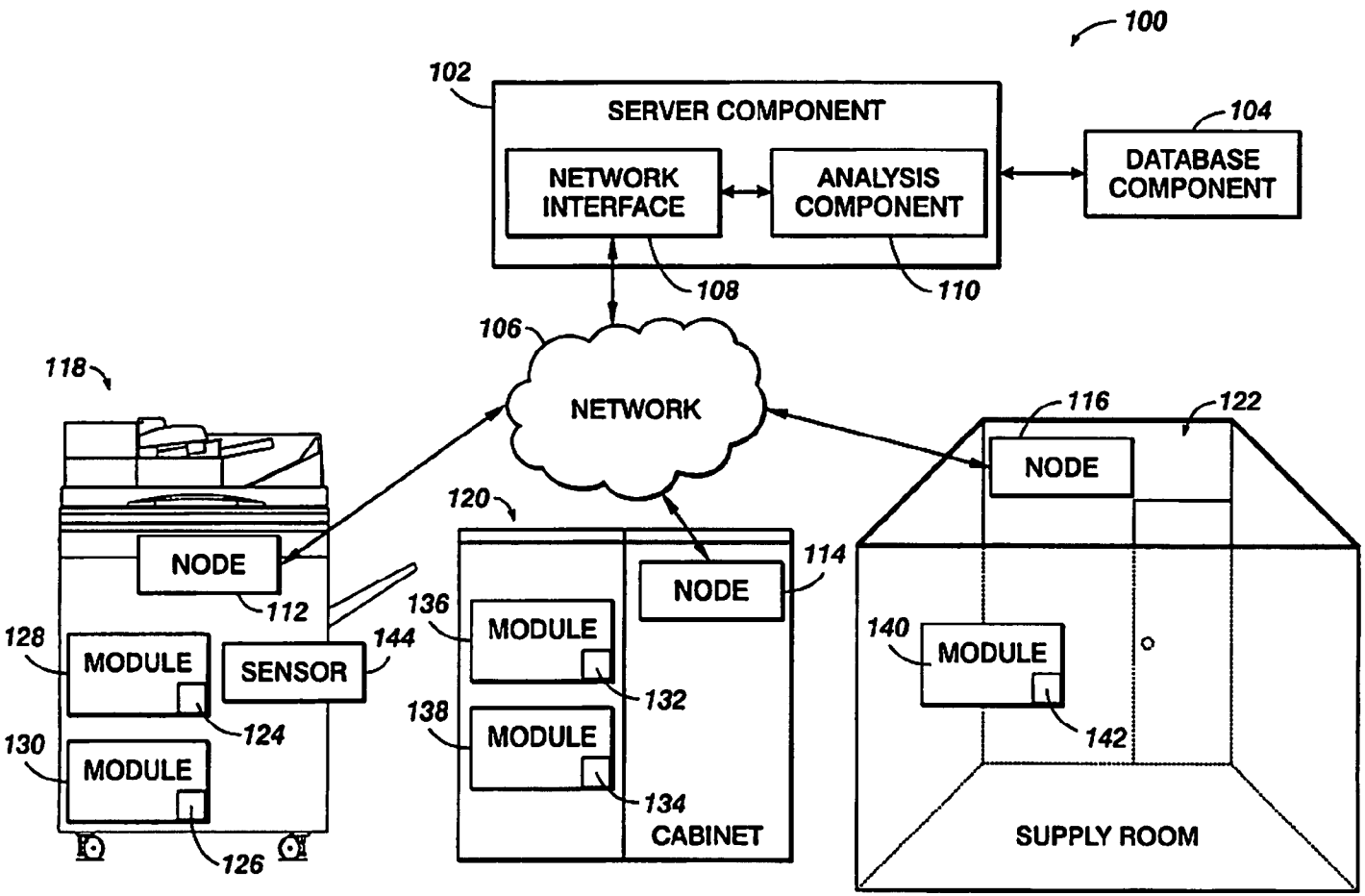
FIG. 1 is a block diagram of a module monitoring system that monitors modules utilizing a plurality of nodes and each node is a node type in accordance with the present disclosure.

Referring to the drawings, FIG. 1 is a block diagram of a module monitoring system 100 that monitors a plurality of nodes, each node being a node type, in accordance with the present disclosure. A module may be a consumer replaceable unit, an installable module installable in a printing machine (e.g., installable by a technician or an end-user) and the like. System 100 includes a server component 102 and a database component 104. Server component 102 and/or database component 104 may be implemented (wholly or partially) in hardware, software, firmware, software in execution, bytecode, or some combination thereof. For example server component 102 and/or database component 104 may be implemented by an x86-processor based computer. Additionally or alternatively, server component 102 and/or database component 104 may be the implemented by the same computing device or separate computing devices. Database component 104 may be a structured query language (commonly abbreviated as "SQL") based database.

Server component 102 and database component 104 can communicate between each other as depicted, e.g., through an Ethernet based network. However, server component 102 may alternatively communicate to database component 104 through a network 106. Network 106 may be the internet, a TCP/IP network, a wired or wireless network, or the like. Additionally or alternatively, server component 102 can communicate to database component 104 using shared memory, e.g., when both are implemented on the same computing device.

Server component 102 includes a network interface 108 and an analysis component 110. Network interface 108 and analysis component 110 are in communication with each other. Network interface 108 interfaces with network 106 facilitating analysis component 110 to be in operative communication with network 106. Analysis component 110 is in operative communication with nodes 112, 114 and 116 by utilizing network interface 108 and network 106.

Nodes 112 through 116 can communicate with RFIDs tags. Each of nodes 112 through 116 can interrogate an RFID tag (via a RFID reader), can write to an RFID tag (via a RFID writer) and includes a network interface to network 106. The RFID reader, RFID writer and network interfaces are not depicted and are the purview of those of ordinary skill in the art. Node 112 is within a printing machine 118 and therefore is a "printer-base node" type; node 114 is within a cabinet 120 making it a "cabinet-based node" type; node 116 is within a supply room 122 making it a "supply-room-based node" type. The printer-based node type 112 is associated with or integrated with a printing machine. As mentioned above, a printing machine may be an image forming apparatus, a printer, a printing system, a copier, a facsimile machine, a multifunction device (e.g., a scanner integrated with a printer) and the like.

Node 112 can communicate with RFID tags 124 and 128, attached to modules 126 and 130, respectively. RFID tags 124 and 126 are within (or relatively near) the communication zone of node 112 making RFID tags 124 and 126 "local" to node 112, i.e. a local RFID tag is an RFID tag within (or near) the communications zone of a respective node. A "corresponding" module is the module attached to a specific RFID tag, i.e., the module corresponds to the RFID tag attached thereto. Node 114 has two local RFID tags, which are RFID tags 132 and 134 attached to modules 136 and 138, respectively. Additionally, supply room 122 contains module 140 that has RFID 142 attached. All of the local RFIDs of nodes 112, 114 and 116 interface are in operative communication with server component 102 via network 106. A module is any part, device, component or apparatus which is installable, repairable, replaceable or transferable from or within a printing machine, or the like. For example, a module may be a CRU, a photoreceptor drum, a photoreceptor belt, a fuser roll, a toner bottle, a toner drum, a fluid container, a filter, a web cartridge, an AC dicor module, a DC charge assay, an AC dicor preclean and/or a developer waste bottle.

Note that server component 102 can communicate with RFID tags attached to its corresponding modules in a variety of physical spaces facilitating large scale tracking and/or information gathering (e.g., global tracking and/or information gathering). Additionally, database component 104 can store related data or information (or analyzed data or information) regarding modules facilitating further analysis by analysis component 110 or may be stored for later retrieval by personnel and/or for retrieval by other computer programs. Data or information relating to a property of a module and/or a property of a RFID tag may be stored by database component 104. Additionally or alternatively, the data or information relating to a property of a module and/or a property of a RFID tag may be stored on the corresponding RFID tag itself utilizing one or more nodes (e.g., nodes 112, 114 and/or 116). The data or information may include a property of a module and/or a property of a RFID tag. For example, nodes 112, 114, and/or 116 may operatively update an approximate level of remaining usage as related to module 130 utilizing the information on RFID tag 126 thereby keeping track of a "level" regardless of whether module 130 is currently near node 112 or node 114. The remaining usage may be used as an indication to determine a level (partial or full) as associated with a module (e.g., ink levels). Additionally, the data or information may relate to counterfeiting. For example, node 112 can interrogate RFID tag 126 to retrieve anti-counterfeiting information and communicate the anti-counterfeiting information to server component 102. Server component 102 can determine if module 126 is a counterfeit module. Thereafter, server component 102 can disable the use of that module within printing machine 118 by sending an appropriate instruction or command via network 106.

The properties stored on database component 104 and/or the respective RFID can be one or more of an End-Of-Life estimate, a version number, a revision number, a firmware version, a manufacturer source, a model number, a shipping number, a date of manufacture, a lot number, a factory association and a pedigree. A pedigree is a travel, manufacturing, repair, and/or rework history of the module and the like. One type of pedigree is a manufacturing pedigree and includes manufacturing information related to the module.

Sensor 144 may be utilized within printing machine 118 to facilitate the determination of a property of module 128. For example, sensor 144 may be a camera, a photodetector, a counter, a non-contact sensor (e.g., to sense wear) or other sensor that may be implemented in a printing machine 118. The End-Of-Life estimate by may be an estimate of the useful life of the module and may be stored on the RFID tags. The End-Of-Life estimate may be determined by analysis 110 utilizing one or more of a page count (e.g., pages printed by the module or with the module in operation), a toner volume, a power-on time, a usage, a remaining usage (e.g., count down device), and/or a pixel cont. The End-Of-Life estimate and/or one of the above mentioned items utilized by the analysis component 110 to determine the End-Of-Life can be stored by database component 103, on RFID 124 and/or on sensor 144.

End-Of-Life estimates may be determined by monitoring actual rates and/or changes in a module (as mentioned above) and may be contrary to predicated End-Of-Life estimates. Analysis component 110 may compare actual or measured End-Of-Life estimates to a predicted End-Of-Life measurement. Analysis component 110 may compare multiple End-Of-Life estimates to multiple predicted End-Of-Life estimates to identify increased-wear modules, despite that the modules are near differing node types. The increased-wear modules may be the result of a printer fault, e.g., from a fault from within printing machine 118. Note again that various increased-wear modules do not need to be within printing machine 118 for analysis component 110 to determine that the increased-wear was from an increased-wear fault within printing machine 118; analysis component 110 only needs to determine if the increased-wear module was ever within printing machine 118. For example, assuming that module 138 is an increased-wear module, analysis component 110 can communicate with database component 104 to determine that module 138 was previously within printing machine 118, and can attribute the increased-wear to a fault within printing machine 118 despite currently being stored in cabinet 120. Analysis component 110 can order replacement modules to compensate for the increased-wear modules. Additionally or alternately, analysis component 110 can order a replacement printing machine part to negate the increased-wear fault.

Analysis component 110 may additionally perform other function by communicating with modules. For example, analysis component 110 can determine inventory levels (e.g., inventory levels of a customer, a region, a particular printing machine, e.g., printing machine 118, a country and the like), usage rates, health statistics, hardware compliance and/or software compliance. For example, analysis component 110 may use one or more modules to determine health statistics of printing machine 118 to determine when the machine needs adjusting, how much of an adjustment is needed and may place an order or issue a "ticket" to facilitate the scheduling of maintenance. For example, analysis component 110 may pre-emptively request service on printing machine 118 to avoid machine breakdown or unacceptable faults.

Figure 2:
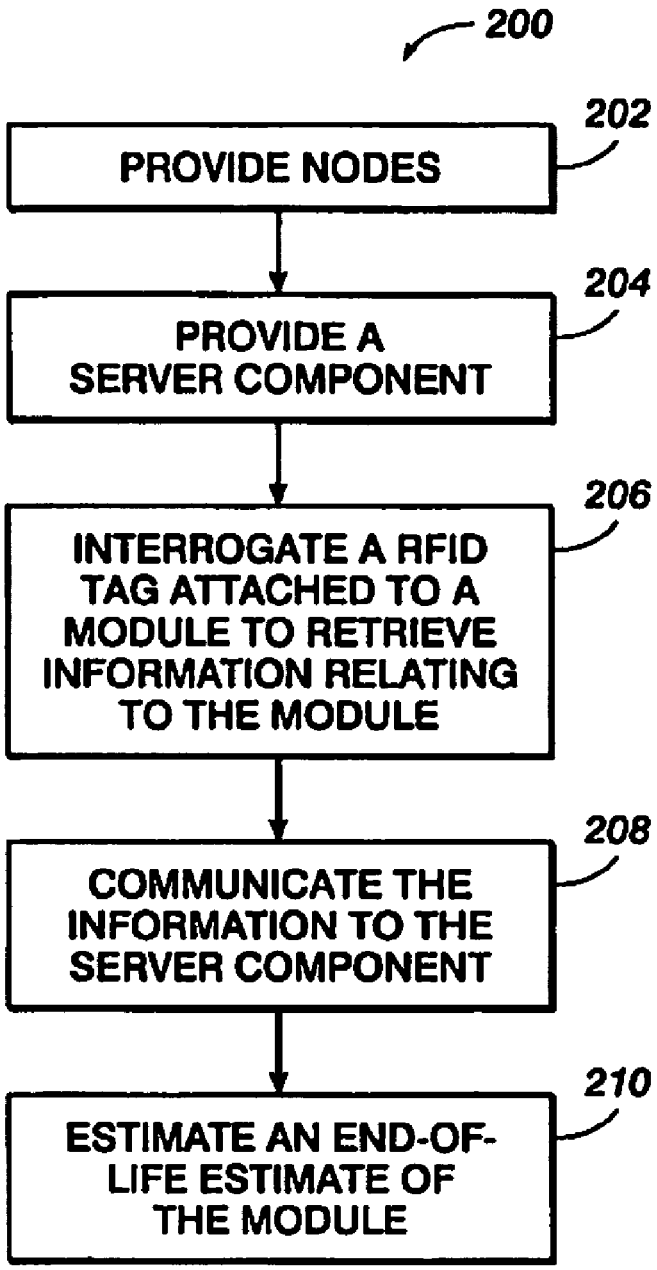
FIG. 2 is a flow chart diagram illustrating a method of monitoring modules in accordance with the present disclosure.

Referring to the drawings, FIG. 2 is a flow chart diagram illustrating a method 200 of monitoring modules in accordance with the present disclosure. Step 202 provides a node, e.g., nodes 112, 114, and/or 116 of FIG. 1. Step 204 provides a server component, such as server component 102 of FIG. 1. Step 206 interrogates a RFID tag attached to a module to retrieve information (such as data, a property of the module and/or the RFID tag and the like) relating to the module. Step 208 communicates the information to the server component and step 210 estimates an End-Of-Life estimate of the module.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A module monitoring system, the system comprising:

a plurality of nodes, wherein each node of the plurality of nodes is configured to operatively communication with a network and is further configured operatively communication with at least one RFID tag attached to a module, wherein each node of the plurality of nodes being a node type of a plurality of node types and at least two nodes of the plurality of nodes being different node types, wherein a node of the at least two nodes is in operative communication with a local RFID tag attached to a corresponding module and the node is a printer-based node associated with a printing machine; and a server component, comprising:

a network interface in operative communication with the network and configured to communicate with the at least two nodes; and an analysis component configured to utilize the network interface to communicate with the node associated with the printing machine such that the analysis component is in operative communication with the local RFID tag attached to the corresponding module, wherein the node associated with the printing machine operatively interrogates the local RFID tag to retrieve information relating to the corresponding module and operatively communicates the information to the server component.

2. The system according to claim 1, wherein another node of the at least two nodes is a cabinet-based node, wherein both the node associated with the printing machine and the another node operatively update an approximate level of remaining usage of the corresponding module utilizing the information on the local RFID.

3. The system according to claim 1, wherein the node associated with the printing machine operatively interrogates the local RFID tag to retrieve the information including anti-counterfeiting information, wherein the anti-counterfeiting information is operatively communicated to the server component and the server component determines if the corresponding module is a counterfeit module.

4. The system according to claim 1, wherein the plurality of node types includes at least one of a printer-based node, a cabinet-based node and a supply-room-based node.

5. The system according to claim 1, wherein the corresponding module is one of a CRU, a photoreceptor drum, a photoreceptor belt, a fuser roll, a toner bottle, a toner drum, a fluid container, a filter, a web cartridge, an AC dicor module, a DC charge assay, an AC dicor preclean and/or a developer waste bottle.

6. The system according to claim 1, the system further comprising:

a database component in operative communication with the analysis component, wherein the analysis component operatively communicates with the local RFID tag attached to the corresponding module to determine a property of at least one of the local RFID tag and the corresponding module, and the analysis component communicates the at least one property to the database component, wherein the database component stores the at least one property and associates the at least one property with the at least one of the local RFID tag and the corresponding module.

7. The system according to clam 6, wherein the at least one property of the corresponding module is at least one of an End-Of-Life estimate, a version number, a revision number, a firmware version, a manufacturer source, a model number, a shipping number, a date of manufacture, a lot number, a factory association and a pedigree.

8. The system according to claim 7, wherein the End-Of-Life estimate is estimated by the analysis component utilizing at least one of a page count, a toner volume, a power on time, a usage, a remaining usage and a pixel count.

9. The system according to claim 8, where the at least one of the page count, the toner volume, the power on time, the usage, the remaining usage and the pixel count is stored in the local RFID tag.

10. The system according to claim 6, wherein the End-Of-Life estimate is compared to a predicated End-Of-Life estimate by the analysis component.

11. The system according to claim 1, the system further comprising:

a sensor configured to sense at least one property of the corresponding module, wherein the sensor operatively communicates the at least one property to a RFID writer, wherein the RFID writer writes the at least one property to the local RFID tag.

12. The system according to claim 1, wherein the analysis component operatively communicates with the plurality of nodes including the at least two nodes to determine a plurality of End-Of-Life estimates, wherein each End-Of-Life estimate corresponds to a corresponding module having a corresponding RFID tag attached thereto, wherein the analysis component utilizes the corresponding RFID tag to determine an End-Of-Life estimate of the corresponding module.

13. The system according to claim 12, wherein the analysis component compares the plurality of End-Of-Life estimates to a plurality of predicted End-Of-Life estimates to identify a plurality of increased-wear modules.

14. The system according to claim 13, wherein the analysis component utilizes the identified plurality of increased-wear modules to identify a printing machine having an increased-wear fault, wherein the increased-wear fault causes the increased-wear modules to have increased-wear.

15. The system according to claim 13, wherein the analysis component orders a replacement module to compensate for an increased-wear module of the plurality of increased-wear modules.

16. The system according to clam 14, wherein the analysis component orders a replacement printing machine part to negate the increased-wear fault.

17. The system according to claim 1, wherein the analysis component operatively communicates with the node to determine at least one of an inventory level, a usage rate of the corresponding module, a printing machine health statistic, a hardware compliance of the corresponding module and a software compliance of the corresponding module.

18. A method of monitoring a module, the method comprising:

providing a plurality of nodes, wherein each node of the plurality of nodes is configured to operatively communication with a network and is further configured to operatively communication with at least one RFID tag attached to a module, wherein each node of the plurality of nodes is a node type of a plurality of node types and at least two nodes of the plurality of nodes being different node types, wherein a node of the at least two nodes is a printer-based node associated with a printing machine and is in operative communication with a local RFID tag attached to a corresponding module; and providing a server component, the server component comprising:

a network interface in operative communication with the network and configured to communicate with the at least two nodes including the node associated with the printing machine; and an analysis component configured to utilize the network interface to communicate with the node associated with the printing machine such that the analysis component is in operative communication with the local RFID tag attached to the corresponding module, operatively interrogating the local RFID tag utilizing the node associated with the printing machine to retrieve information relating to the corresponding module; and communicating the information to the server component.

19. The method according to claim 18, the method further comprising:

estimating an End-Of-Life estimate of the corresponding module.

* * * * *